US006079518A

United States Patent [19]

Cho

[11] Patent Number: 6,079,518

[45] Date of Patent: Jun. 27, 2000

[54] ABSEIL RESCUE DEVICE

[76] Inventor: Kunlin Cho, 17 Alley 1, Lane 43, Tapeng Road, Taichung, Taiwan

[21] Appl. No.: 09/294,472

[22] Filed: Apr. 20, 1999

[51] Int. Cl.[7] ..... A62B 1/14

[52] U.S. Cl. ..... 182/193; 182/5

[58] Field of Search ..... 182/193, 192, 182/5; 188/65.4, 65.5

[56] References Cited

U.S. PATENT DOCUMENTS 4,883,146 11/1989 Varney ..... 182/5

*Primary Examiner*—Alvin Chin-Shue

*Attorney, Agent, or Firm*—Connolly Bove Lodge & Hutz LLP

[57] ABSTRACT

An abseil rescue device comprises a pair of holders, a pair of retarders a plurality of gripper blocks, a rescue rope, at least a hydraulic cylinder, a press part, a crank seat, and a crank lever. The retarders and the gripper blocks are hingedly connected to one of the holders. A plurality of grippers are provided on the holders and the retarders. The hydraulic cylinder is fixed to one of the holders. The press part is fixed to the hydraulic cylinder. The crank seat is fixed to the hydraulic cylinder. The crank lever is slidably located in the crank seat. The hydraulic cylinder is actuated by the crank lever to allow the press part presses the gripper blocks and the grippers on one of the retarders such that the rope is crossly clamped in S shape to retard the descending speed.

3 Claims, 5 Drawing Sheets

ABSEIL RESCUE DEVICE

BACKGROUND OF THE INVENTION

1. Field of the Invention

The present invention relates to an abseil rescue device, particularly to an abseil rescue device having a brake actuated by a hydraulic cylinder, which allows a user to operate the rescue device with a light hand control.

2. Description of Related Art

In U.S. patent application Ser. No. 09/112,534, as shown in FIG. 5, an abseil rescue system with a velocity control system disclosed by the inventor comprises a pair of holders 10, 11, a pair of retarders 12, 13, and a pair of brakes 14, 15. The holders 10, 11, the retarders 12, 13, and the brakes 14, 15 are hingedly connected with one another by a shaft 18 such that grippers at an end thereof (not shown clearly) can execute to clamp an escape rope 26. The grippers on the holders 11, 12 are positioned oppositely and enclose the escape rope while the holders 11, 12 are closed to abut against each other. The grippers on the retarders 12, 13 and the brakes 14, 15 are alternately disposed one another beside the grippers on the holders 10, 11, respectively, such that the escape rope 26 can be clamped to form a shape of S by the grippers while the rescue device is operated. The retarders 12, 13 at the other ends thereof attach a safety cord 16 for putting around a user's waist. Thus, the weight of the user causes the retarders 12, 13 to held together and the grippers thereon press against the rescue rope 26 such that an uniform friction can be applied onto the rescue rope 26. The brakes 14, 15 at the other ends thereof attach a pulling cord 17 to be pulled by the user such that the grippers thereon press against the rescue rope 26 either and an additional friction can be generated onto the rescue rope 26. Thus, the descent velocity of the user can be controlled by the hand force. But, some persons are unable to apply their hand forces completely while they are nervous in case of an emergency condition. Furthermore, women and children usually have a less hand force to operate the rescue system. Consequently, it still results in poor braking effect under a condition of an inadequate hand force such that an unsteady descent velocity is unavoidable to occur.

SUMMARY OF THE INVENTION

The present invention resides in that at least a hydraulic cylinder is adopted to adapt with one of the holders and generate an auxiliary force exerting the grippers on the the retarders and gripper blocks disposed near by the grippers. Therefore, only a light force is required for any one to operate the rescue device without changing the original retarding function described in application Ser. No. 09/112,534.

An object of the present invention is to provide an abseil rescue device, which allows the grippers on the the retarders and gripper blocks near by the grippers to clamp the rescue rope synchronously such that a more flexible control of descent velocity can be reached.

Another object of the present invention is to provide an abseil rescue device, with which a hydraulic cylinder is adapted to press the grippers and the gripper blocks such that only a light hand force is required to acquire a steady decent operation.

The present invention can be more fully understood by reference to the following description and accompanying drawings.

DETAILED DESCRIPTION OF THE PREFERRED EMBODIMENTS

Figure 1:
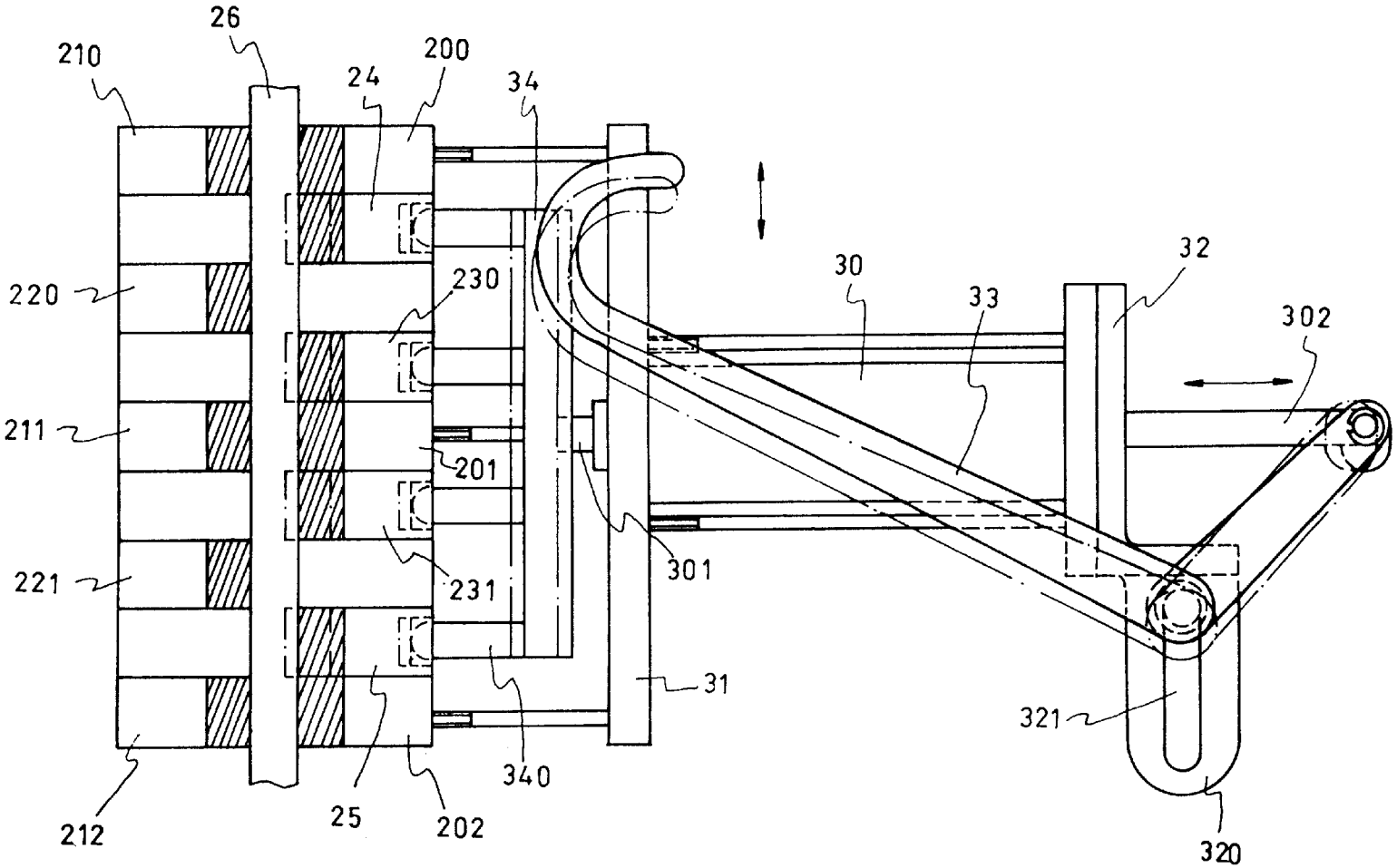
FIG. 1 is a top view of a preferred embodiment according to the present invention.
Figure 2:
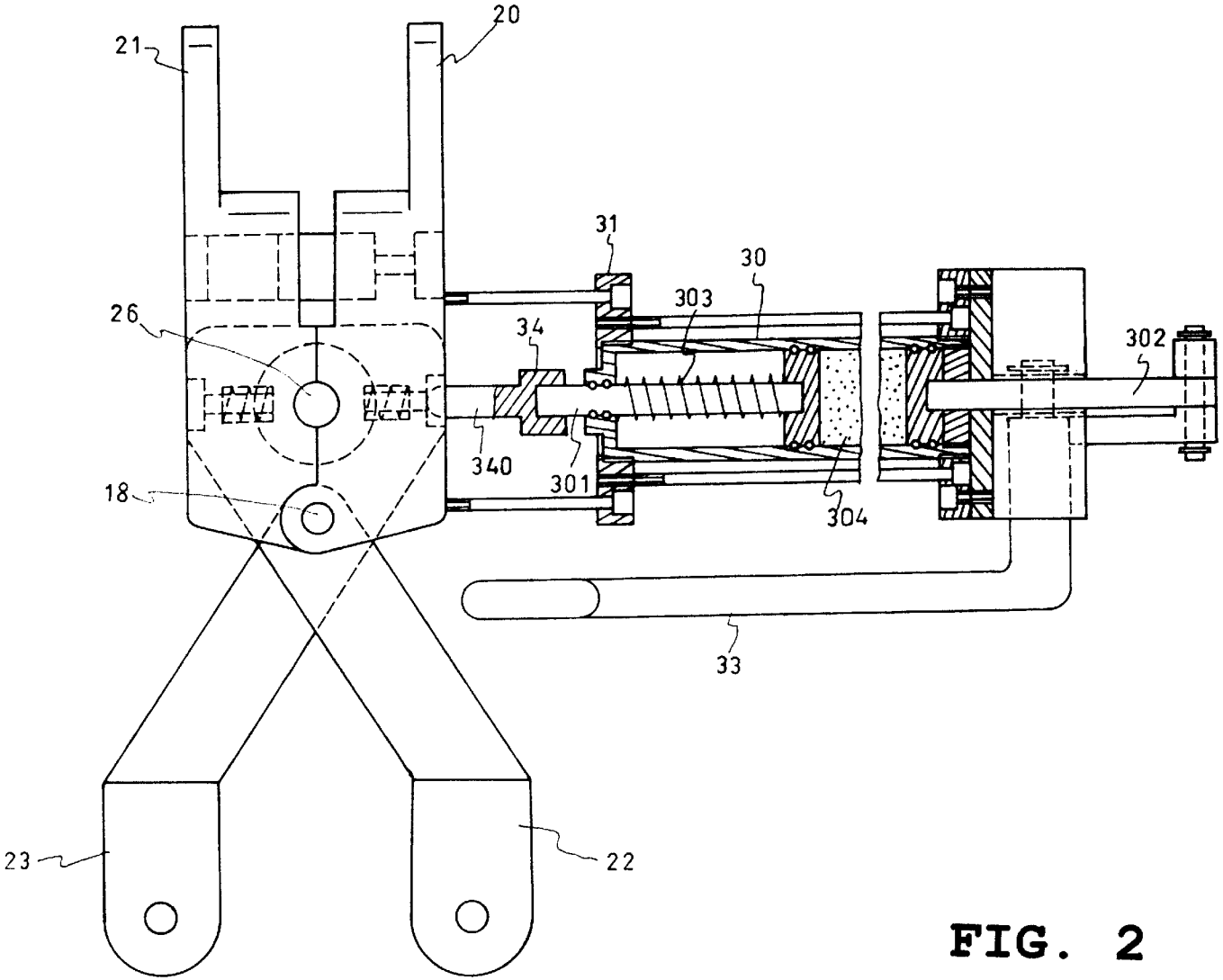
FIG. 2 is a front view of the preferred embodiment shown in FIG. 1.

As shown in FIGS. 1 and 2, an assembly of a preferred embodiment according to the present invention is illustrated. Basically, a pair of holders 20, 21, a pair of retarders 22, 23, and two gripper blocks 24, 25 are arranged to hingedly connect one another by a shaft 18 in the rescue device. The grippers 200, 201, 202 are provided on the holder 20, and the grippers 210, 211, 212 are provided on the holder 21 corresponding to the grippers 200, 201, 202, respectively. Thus, the grippers 200, 201, 202 and the grippers 210, 211, 212 are oppositely positioned respectively to enclose a rescue rope 26 while the holders 20, 21 are closed to abut against each other. The grippers 230, 231 are on the retarder 23 and alternately disposed between the grippers 200, 201, 202, respectively. The grippers 220, 221 are on the retarder 22 and alternately disposed between the grippers 210, 211, 212, respectively. The gripper block 24, 25 are disposed to adjoin the grippers 200, 202 on the holder 20 respectively It can be seen that a hydraulic cylinder 30 is attached to the holder 20 at a lateral side thereof. A press part 34 is provided to located between the hydraulic cylinder 30 and the holder 20. The press part 24 further has push studs 340 to contact with the gripper blocks 24, 25 and grippers 230, 231 respectively. A crank seat 32 is fixed to the hydraulic cylinder 30 at the rear side thereof. A tail base 320 is located at the lower end of the crank seat 32 with a sliding slot 321. A crank lever 33 is provided in the sliding slot 321. The crank lever 33 is connected to a rear shaft 302 on the hydraulic cylinder 30. When the crank lever 33 is pressed by a force, the rear shaft 302 is moved forward to push a front shaft 301 and the press part 34. Thus, the push studs 340 push the gripper blocks 24, 25 and the grippers 230, 231 toward a rescue rope 26 corresponding to the gaps in the grippers 210, 211, 212, 220, and 221. Therefore, the rescue rope 26 can be clamped in S shape and a controlled decent velocity can be reached.

Referring to FIG. 2 again, it can be seen that a front shaft 301 and a rear shaft 302 provided along the axial direction of the hydraulic cylinder 30. An oil chamber 304 is located between the front and the rear shafts 301, 302. A spring 303 is placed around the front shaft 301 in the cylinder 30. The rear shaft 302 extends an end out of the cylinder 30. The crank seat 32 is attached at the outer end to allow the rear shaft 302 moving in the crank seat 32. The crank lever 33 is fixed to the outer end of the rear shaft 302. The crank lever 33 has a bent part at an end thereof slidable in the sliding slot 321. When the other end of the crank lever 33 is pressed by a force, the bent part slightly displaces downward to carry the outer end of the rear shaft 302 moving horizontally. The rear shaft 302 then pushes the oil in the chamber 304 forward. Then, the front shaft 301 is moved forward to push the press part 34 forward either. When the other end of the crank lever 33 is released from the force, the spring 303 bounces back to pull the front shaft 301 backward with the oil chamber 304. Then, the rear shaft 302 moves backward to restore the crank lever to the original position. While the press part 34 moves forward, the push studs 340 press the gripper blocks 24, 25 and the grippers 230, 231 toward the escape rope 26 to allow the rope 26 clamped in S shape so as to achieve a retard function. A descent velocity of the user thus can be controlled steadily.

Figure 3:
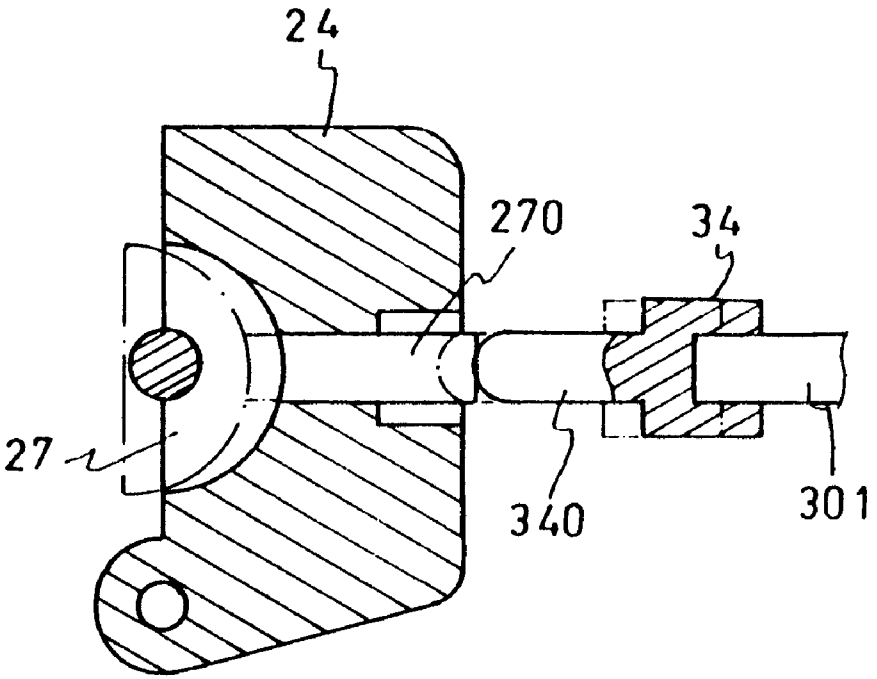
FIG. 3 is a schematic illustration of another preferred embodiment according to the present invention.

As shown in FIG. 3, another embodiment according to the present invention is illustrated. A fixing bar 270 is adopted to fasten the brake pad 27 in the gripper block 24 instead of a bolt used in the prior art. The push stud 340 in front of the press part 34 contacts with the fixing bar 270 directly. When the press part 34 is moved by the front shaft 301, the push stud 340 moves the brake pad 27 through the fixing bar 270 directly with the gripper 24 being kept unmoved. It is noted that the illustrated arrangement for the fixing bar 270 in the gripper block 24 is provided in the gripper block 25 and the grippers 230, 231 either.

Figure 4:
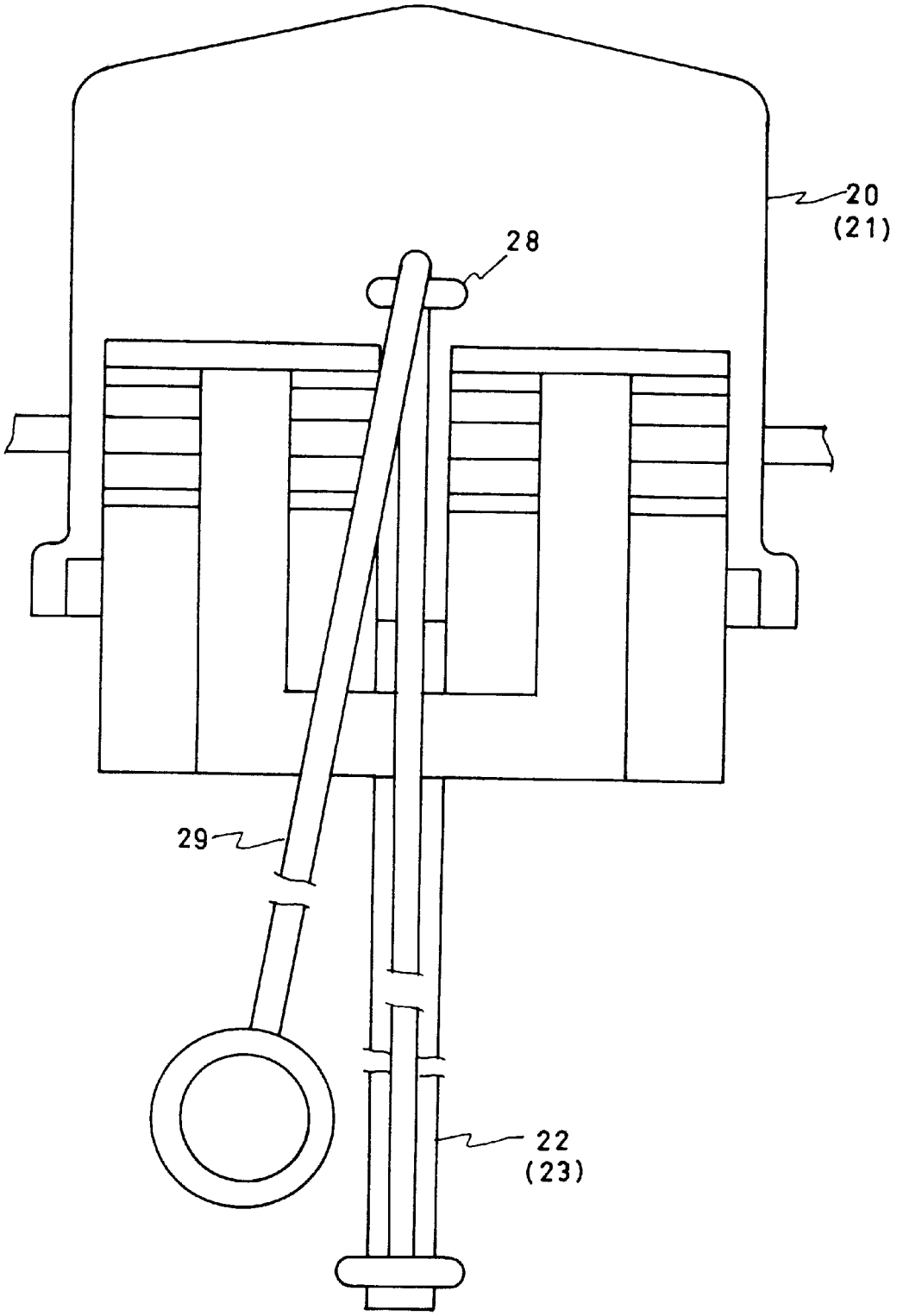
FIG. 4 is a schematic illustration of a further embodiment according to the present invention.
Figure 5:
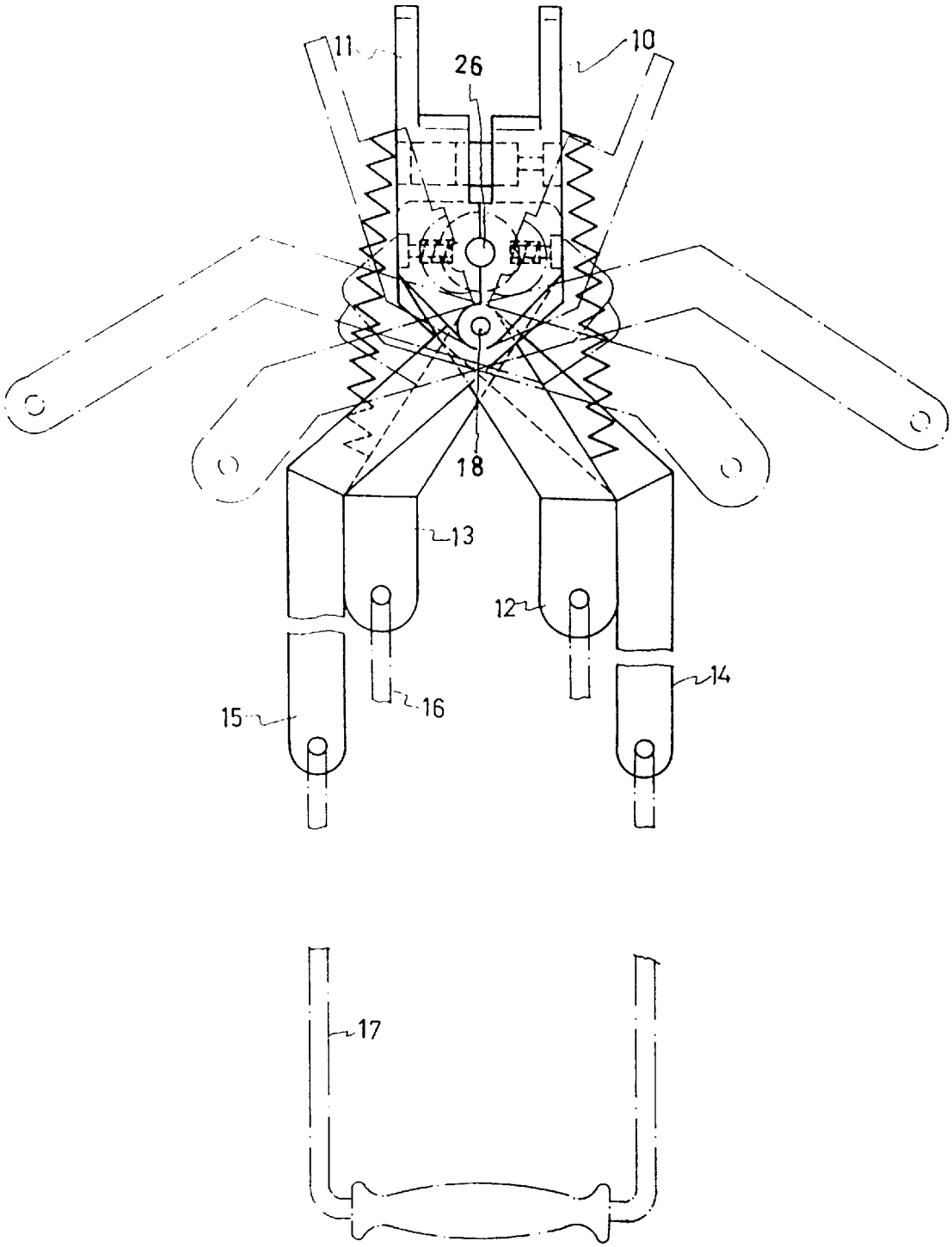
FIG. 5 (PRIOR ART)
FIG. 5 is a schematic illustration of the prior art.

As shown in FIG. 4, a further embodiment is illustrated. A hollow guide 28 is fixed to a lateral side of the holder 20 (or 21). An auxiliary cord 29 passes through the guide 28 with an end thereof linking one of the retarders 22, 23. Once the auxiliary cord 29 is pulled, the grippers 220, 221 on the retarder 22 or the grippers 230, 231 on the retarder 23 will lessen the clamping force acting on the escape rope 26 to accelerate the descent velocity. The preferred embodiment provides the following advantages: —

1. The brakes can be swung to avoid being jammed by residues resulting from wear and tear of brake pads.
2. It is avoidable that a jamming derived from a too great press force of the hydraulic cylinder.
3. In order to be away from an expanding flame quickly, an increased decent velocity can be reached easily.
4. It is possible to speed up releasing the press force of the hydraulic cylinder and assist bouncing back the spring.
5. It is possible to enhance the safety of the user when the device regarding the auxiliary cord is applied to the rescue system disclosed in the U.S. patent application Ser. No. 09/112,534.

While the invention has been described with reference to preferred embodiments thereof, it is to be understood that modifications or variations may be easily made without departing from the spirit of this invention which is defined by the appended claims.

What is claimed is:

1. An abseil rescue device comprising:

a shaft;

a pair of holders hingedly connected by said shaft;

a pair of retarders, being hingedly connected to said holders by said shaft, and each of said retarders having grippers thereon respectively;

a plurality of gripper block; being hingedly connected to said holders by said shaft; and at least a hydraulic cylinder device fixing to one of said holders;

said hydraulic cylinder device further comprising a hydraulic cylinder with a first end and a second end, having a first shaft being surrounded by a spring and extending out of said first end and a second shaft extending out of said second end, having an oil chamber connecting said first shaft and said second shaft therein;

a press part, being located near said first end and connected to said first shaft;

a plurality of push studs, being corresponding to the gripper blocks and the grippers on one of said retarders respectively, each of said push studs having two ends, one end thereof attaching to said press part, and the other end contacting either one of said gripper blocks or one of said grippers on said retarder;

a locating base, attaching to said second end of the hydraulic cylinder and having a slot therein; and a lever with an end, said end being slidably fitted with said slot in the locating base, having a bent part on said end, said bent part thereof fixing to said second shaft outside said second end the hydraulic cylinder.

2. An abseil rescue device according to claim 1, wherein each of the gripper blocks and each of the grippers on said retarder are provided with a friction pad attached to a fixing bar respectively, and the fixing bar contacts said push stud.

3. An abseil rescue device according to claim 1, wherein a hollow guide is fixed to one of said holders and an auxiliary cord passes through the hollow guide with an end thereof linking one of said retarders.

* * * * *